United States Patent [19]

Marsh

[11] 4,395,086

[45] Jul. 26, 1983

[54] ELECTRICAL CONTACT FOR ELECTRICAL CONNECTOR ASSEMBLY

[75] Inventor: Edward K. Marsh, Orlando, Fla.

[73] Assignee: The Bendix Corporation, Southfield, Mich.

[21] Appl. No.: 255,600

[22] Filed: Apr. 20, 1981

[51] Int. Cl.[3] ..... H01R 13/50

[52] U.S. Cl. ..... 339/176 M

[58] Field of Search ..... 339/176 R, 176 M, 258 R, 339/258 P

[56] References Cited

U.S. PATENT DOCUMENTS

| | | | |
|---|---|---|---|
| 3,492,631 | 1/1970 | Olsson | 339/176 M |
| 3,827,005 | 7/1974 | Friend | 339/258 P |
| 3,871,736 | 3/1975 | Carter | 339/256 R |
| 4,004,845 | 1/1977 | Sochor | 339/258 P |
| 4,030,792 | 6/1977 | Fuerst | 339/176 M |

FOREIGN PATENT DOCUMENTS

| | | | |
|---|---|---|---|
| 807420 | 2/1981 | U.S.S.R. | 339/258 P |

*Primary Examiner*—Eugene F. Desmond
*Assistant Examiner*—Paula Austin
*Attorney, Agent, or Firm*—Charles D. Lacina

[57] ABSTRACT

An electrical terminal element (34) for electrically interconnecting with a conductive V-shaped blade (52), the terminal element (34) characterized by including a plurality of spaced jaw members (42, 44) for receiving the blade (52) inserted therebetween, the jaw members defining a slot (46) therebetween and all of the slots (46) being aligned with and in register with one another.

16 Claims, 9 Drawing Figures

FIG. 6
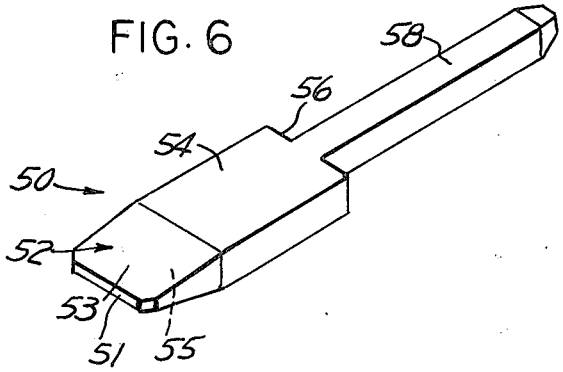
FIG. 7
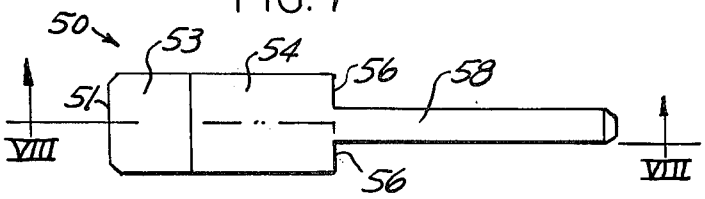
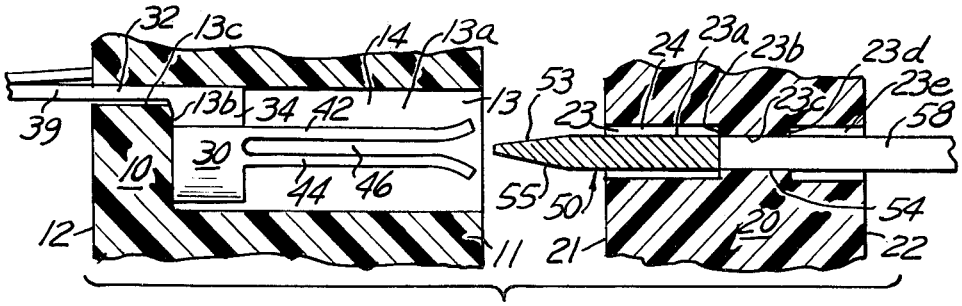
FIG. 8
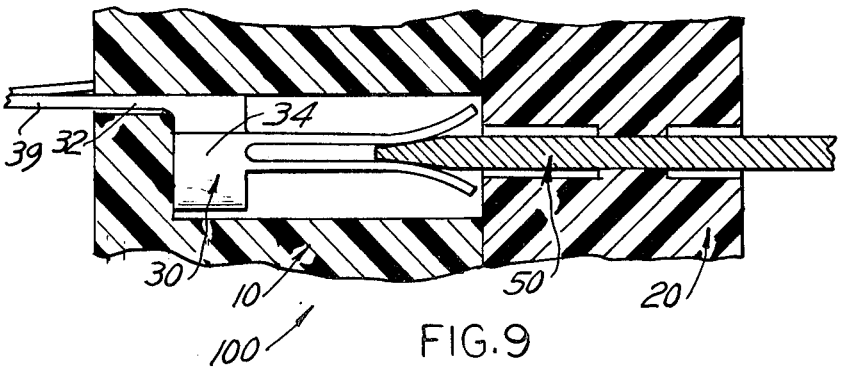
FIG. 9

ELECTRICAL CONTACT FOR ELECTRICAL CONNECTOR ASSEMBLY

This invention relates to an electrical contact for an electrical connector of the type wherein printed circuit boards are interconnected and more particularly to a mating between a relatively rigid pin-type contact and a resilient contact having conductive portions which spread apart upon engagement by the pin.

A printed circuit board typically includes a number of circuit paths which are designed to be electrically interconnected with other circuit paths on the board or with other circuit boards. This has frequently been accomplished by suitably locating a mounting hole on the respective board and disposing a contact in the hole on one board for mating with a compatible contact on the other board. Depending on the application, the holes may be plated and be located on a desired circuit path. As a number of contacts increase, the force required to mate the contact pairs increases considerably. A user normally desires a contact-to-contact mating requiring low mating forces. With conventional pin and socket contacts, a large number of contacts require large mating forces. The amount of force needed to mate standard pin and socket contacts is in the range of 2 to 6 oz. per mated contact. A reduction in the normal force at the contact interface would be desirable. A hermaphroditic brushtype contact having a plurality of axially aligned mating wires and disclosed in U.S. Pat. No. 3,725,844 filed Mar. 15, 1971 meets the low mating force requirement without sacrificing electrical performance. A disadvantage of using this brush-type contact was the large number of component parts which had to be accurately assembled to provide a pair of mateable contacts.

A tapered pin-type contact disclosed in U.S. Pat. application Ser. No. 928,923 filed July 28, 1978 and in U.S. Pat. application Ser. No. 164,124, filed June 30, 1980 reduced the component parts required to provide a pair of mateable contacts while still providing a low force spreadable mating with the above brush-type contact. However, and although providing an acceptable electrical interconnection, the pin type contact of the former Patent application provides only one line of (tangency) contact between each conductive wire of the brush and the exterior surface of the pin and a possibility exists that if the brush consists of a small number of spreadable wires (e.g. two) that each wire could skew upon mating, thereby diminishing contact with the surface of the pin. The latter Patent application discloses an improved pin which increases the amount of surface contacted by each wire when spread apart by the pin. In each, the resulting electrical interconnection was dependent on each brush wire being spread by the pin and a firm interlocking engagement was not really possible since of the spread brush is limited. However, and with each pin, although the number of current paths are increased, the wires can be damaged (e.g. stubbed) if not properly intermingled.

A more desirable contact would be one having a spreadable portion that provides low insertion force; good mating characteristics and multiple contact points (electrical redundancy) when a compatible contact is inserted therein to form an electrical interconnection.

DISCLOSURE OF THE INVENTION

In accordance with the present invention, an electrical interconnection is disclosed wherein a pin-type contact comprising a V-shaped blade having a leading edge and a pair of flat surfaces tapering rearwardly therefrom and adapted to mate with a contact stamped from a flat sheet of metal and formed into a leaf-like contact characterized by an open-ended slotted terminal element including a plurality of interconnected plate portions having like forward edges thereof disposed for mating contact with the blade, the slots extending inwardly from the forward edge of each of the plate portions with all of the slots being in register (alignment) for receiving the blade inserted therebetween for the interconnection.

An advantage of the leaf-like contact is maintenance of strong contact forces to assure a good electrical contact without an increase in mating forces.

Another advantage of the leaf-like contact is provision of a mateable contact having a mateable portion which is rugged and not easily susceptible to stubbing or becoming damaged.

Still another advantage of the present invention is an electrical connection that provides multiple contact points (electrical redundancy) between the mated contacts.

Yet another advantage of the present invention is provision of one-piece electrical contacts.

Other objects and advantages of the present invention will become apparent to the reader in view of the following detailed description in the claims accompanying the drawings.

BRIEF DESCRIPTION OF THE DRAWINGS

FIG. 6 is a perspective view of a blade-type contact according to the present invention.

FIG. 7 is a top view of a blade-type contact of FIG. 6.

FIG. 8 is a side view in section of a pair of circuit boards, the leaf-type contact and the blade-type contact about to be assembled to provide an electrical interconnection.

FIG. 9 is a partial view in section of the electrical interconnection.

DETAILED DESCRIPTION OF THE INVENTION

Figure 1:
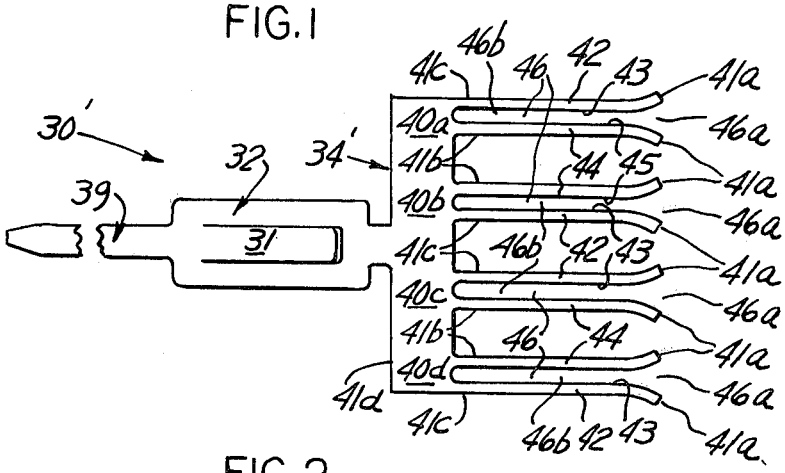
FIG. 1 is a plan view of a contact body form stamped from generally flat sheet metal.

Referring now to the drawings, FIG. 9 shows a partial view in cross-section of an electrical interconnection 100 according to the present invention and includes a pair of support members 10, 20 and a leaf-type electrical contact 30 mated with a blade-type electrical contact 50. Although only one of each contact is shown, it is understood that a plurality of each contact type would be carried by each of the support members. The leaf-type contact comprises a central body portion 32 having first and second terminal portions 34, 39 extending therefrom, the first terminal portion 34 defining an open-ended slotted terminal element for mating contact with the conductive blade of the other electrical contact 50.

FIG. 8 is a side view in section of the support members 10, 20 having the contacts 30, 50 mounted in their passages and disposed for assembly. Preferably and in accord with the invention, the support members 10, 20 would be characterized by printed circuit boards with each circuit board being comprised of a dielectric material and each having, respectively, a front mating face 11, 21, a rear face 12, 22 and a passage 13, 23 extending between the faces for receiving the respective contacts. One or both faces of the circuit boards could be provided with circuit paths and/or electrical components to be electrically interconnected and each passage could be soldered or plated with conductive material to provide an electrical circuit path between respective of the contacts and circuit paths disposed on one or both of the circuit boards.

Passage 13, extending through circuit board 10 is sized to receive the leaf-like contact 30 and includes a first passage portion 13*a* extending from the front mating face 11 inwardly to a shoulder 13*b* and a second passage portion 13*c* extending from the rearward face 12 forwardly, the first passage portion 13*a* and shoulder 13*b* defining a cavity 14 for positioning and mounting terminal element 34 and the second passage portion 13*c* providing a mounting aperture for body portion 34 and an opening for the terminal portion 39 for an off-board connection (such as by a wire-wrap) of the contact.

Passage 23, extending through the circuit board 20, is sized to receive the blade-type electrical contact 50 and includes a forward passage portion 23*a* extending from the front mating face 21 inwardly to interior shoulder 23*b*, a rearward passage portion 23*e* extending inwardly from the rear face 23 to interior shoulder 23*d* and an intermediate passage portion 23*c* extending between the interior shoulders 23*b*, 23*d*, the forward passage portion 23*a* and interior shoulder 23*b* defining a recess 24 for positioning and mounting the mating end of the blade-contact, the intermediate passage portion 23*c* being sized to interference fit with an intermediate body portion 52 of the blade-contact.

Turning now to FIG. 1, preparatory to forming the leaf-type contact 30 according to this invention, a substantially flat, planar sheet of conductive metal has a contact body form 30' stamped therefrom. As shown, the contact body form 30' comprises terminal portions 34', 39 and the center body portion 32. The center body portion includes a resilient tang 31 struck outwardly therefrom to provide means for mounting the contact into the passage of the printed circuit board. Terminal portion 34', although one-piece, can be considered as comprising a plurality of interconnected rectangular plate-portions 40*a*, 40*b*, 40*c*, 40*d* with each having like edges arranged to correspond. These like edges define a forward edge 41*a*, a pair of lateral edges 41*b*, 41*c* and a rearward edge 41*d*. A narrow slot 46 extends inwardly from the forward edge 41*a*.

Each slot 46 defines a pair of spaced jaw members 42, 44 for receiving the blade-contact, the jaw members having flat edge surfaces 43, 45 respectively which face one another for engaging the blade, each edge surface 43, 45 being disposed in a plane generally perpendicular to the plane of the sheet. The slot 46 includes a gradually diverging portion forming an opening 46*a*, for receiving the leading edge of the blade and a substantially parallel portion forming a blade engaging section 46*b* for holding the blade.

Figure 2:
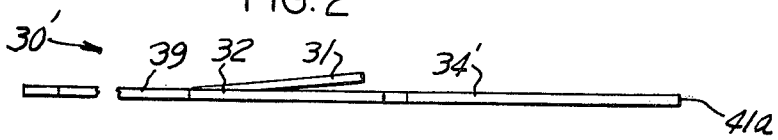
FIG. 2 is side view of the body form of FIG. 1.

FIG. 2 is a side view of the contact body form 30'.

Figure 3:
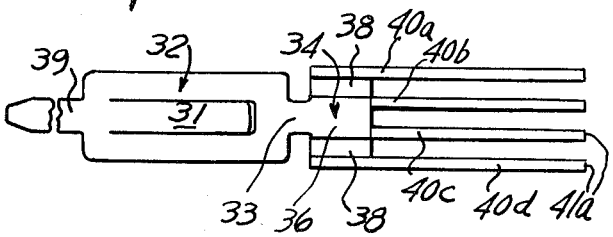
FIG. 3 is the body portion of FIG. 1 formed into a leaf-type contact according to the present invention.

FIG. 3 is the contact body form 30' of FIG. 1 formed into the desired shape and shows an end view of the leaf-type contact 30 according to the present invention. The electrical contact comprises the central body portion 32 having tine 31 for mounting the contact in the circuit board 10 passage, the terminal portion 39 integral with the central body portion 32 and sized to project from the rearward (bottom) face 12 of the circuit board 10 and the terminal portion 34 formed into terminal element projecting from the central body portion 32 and sized to be mounted in the cavity 14 of passage 13, the terminal element 34 comprising the four closely spaced, parallel, substantially planar plate-portions 40*a*, 40*b*, 40*c*, 40*d* having the slot 46 extending inwardly from the forward edge 41.

A neck (flange) 33 connects the central body 32 to the web 36 of the terminal element 34.

Two pairs of plate-portions are interconnected by a bight 38 to form first and second plate-sections (35, 37) and each of the respective plate-sections are connected by a web 36.

Figure 4:
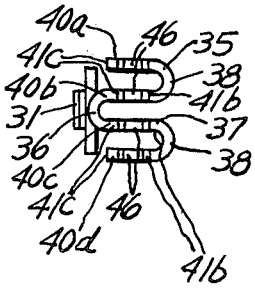
FIG. 4 is a top view of the leaf-type contact FIG. 3.

FIG. 4 is a top view of the leaf-contact 30 of FIG. 3. As shown, the contact is formed into a wavy or sinusoidal type cross-section wherein the plate portions 40*a*, 40*b*, 40*c*, 40*d* are parallel one to the other and the slots 46 disposed in register (in alignment) with one another. In general the contact provides a first row of aligned jaw members 42 ("leafs") which have their edge surfaces 43 in confronting relation to edge surfaces 45 of a second row of aligned jaw members 44 ("leafs").

The first two plate-portions 40*a*, 40*b* comprise the first plate-section 35 and the next or second two plate-portions 40*c*, 40*d* comprise the second plate-section 37. A first bight 36 extends along the lateral edges 41*b* of the first two plate-portions 40*a*, 40*b* and a second bight extends along the lateral edges 41*b* of the second two plate-portions 40*c*, 40*d* respectively to form the plate-sections 35, 37. Each plate-section 35, 37 has one plate edge connected by a web 38. The web 38 extends along the second lateral edges 41*c* of plate-portion 40*b* of plate section 35 and of plate-portion 40*c* of plate section 37. It is possible that in some applications it may be desirable to have the web 38 connect the outside plates 40*a*, 40*d* rather than the interior plates 40*b*, 40*c*.

Figure 5:
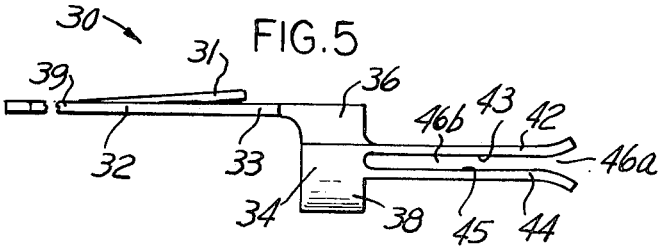
FIG. 5 is a side view of the leaf-type contact of FIG. 3.

FIG. 5 is an side view of the leaf-contact 30 of FIG. 3. The terminal portion 39 comprises an elongated stem portion having rectangular cross-section for additional interconnection (such as by wire-wrap) with another member or interference fit within a plated aperture of another board.

FIG. 6 is a perspective view of the blade-type contact 50 of FIGS. 8 and 9 according to this invention. The blade-type contact includes a (terminal) blade 52, a central body portion 54 and a terminal end portion 58. The blade 52 is generally V-shaped in cross-section having a blunt forward leading edge 51 and a pair of substantially flat surfaces 53, 55 tapering rearwardly and outwardly therefrom, the terminal blade 52 forming a wide work engaging portion adapted to spread apart the jaw members 42, 44 of the leaf-type contact 30. A trailing edge portion 56 abuts against part of interior passage shoulder 23*b* to position the blade of the contact relative to the passage. The central body portion 54 of the blade-type contact interference fits in the passage 23*c*. The terminal end portion 58 of the contact is substantially rectangular in shape to form a wire rap for a secondary electrical interconnection.

FIG. 7 is a top view of the blade-type contact 50 shown in FIG. 6.

Turning again to FIG. 8, the contacts according to thus invention are in position for mating. The central body portion 32 of the leaf contact 30 is fit within the second passage portion 13*c*. The tang 31 may interference fit against the passage wall (not shown) or against the rear (bottom) 12 face of the board. The blade-type contact 50 is shown, for this view, taken along lines VIII—VIII of FIG. 7. The flat faces 53, 55 of the blade 52 describes an included angle of about 24°, although a slightly different angle would suffice. The leading edge of the blade is positioned to be received by the slotted terminal portion 34.

FIG. 9 shows the assembled interconnection with the blade 52 having been wedged within the aligned slots of the leaf-like contact and the jaw members thereof spread laterally apart to provide two lines of electrical contact. Although not shown, the four pairs of jaw members provides least eight lines of biased electrical contact to provide a high degree of electrical redundancy and contact with the blade. One benefit of this is that any oxidation that may build up is more likely to be overcome by the increased contact. Further, a better electrical interconnection is achieved by the increased contact area engaged by the contact surfaces.

Each jaw member defines a pair of beams having resilient but yet adequate bias force to engage and grip the planar surfaces 53, 55 of the blade. Low engagement force results from flexure of the thin narrow beams of sufficient length to exhibit a low bend force. Typically, the amount of force needed to mate the blade and the leafs of the slotted terminal element would be in the range of 1–2 oz.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

Having described the invention, what is claimed is:

1. An electrical contact for electrically interconnecting with a conductive blade, the contact characterized by a plurality of interconnected plate-portions (40) with each said plate-portion (40) having a lateral forward edge (41*a*) and a longitudinal slot (46) extending inwardly from the lateral forward edge, said slots (46) being aligned with one another and defining the axis of a single uninterrupted passage that extends through all the plate-portions, the plate-portions cooperating to form a common jaw for receiving the blade.

2. An electrical contact as required by claim 1 including four closely spaced substantially flat plate portions (40*a*, 40*b*, 40*c*, 40*d*).

3. An electrical contact as required by claim 2 wherein each of said plate-portions (40*a*, 40*b*, 40*c*, 40*d*) are disposed in substantially parallel relationship with one another.

4. An electrical contact as required by claim 2 wherein each of said plate-portions (40*a*, 40*b*, 40*c*, 40*d*) are substantially rectangular to define four edges (41*a*, 41*b*, 41*c*, 41*d*), the first two plate-portions (40*a*, 40*b*) being interconnected to define a first plate-section (35) and the last two plate portions (40*c*, 40*d*) being interconnected to define a second plate-section (37), the plate-sections (35, 37) arranging the plate portions such that their like edges (41*a*, 41*b*, 41*c*, 41*d*) correspond.

5. An electrical contact as required by claim 2 wherein a first pair of said plate portions (40*a*, 40*b*) are interconnected to define a first plate-section (35) and a second pair of said plate portions (40*c*, 40*d*) are interconnected to define a second plate-section (37), said plate-sections (35, 37) arranging the plate portions such that their like edges (41*a*, 41*b*, 41*c*, 41*d*) correspond.

6. An electrical contact as required by either claim 4 or 5 wherein the respective plate-portions are interconnected by a bight (38) extending along the corresponding second edges (41*b*) of said plate portions.

7. An electrical contact as required by claim 6 wherein said plate-sections (35, 37) are interconnected by a web (36), said web (36) extending along a corresponding third edge (41*c*) of one plate portion (40*b*, 40*c*) of each respective plate-section.

8. An electrical contact as required by claim 2 further including a terminal portion (39) for interconnecting with a second conductive member, said terminal portion comprising an elongated post extending from the terminal element.

9. An electrical contact as required by claim 8 further comprising a central body portion (32) having one end connected to the terminal portion (39) and a neck (33) which interconnects the terminal element (34) to the body portion (32).

10. An electrical contact as required by claim 1 wherein the blade (52) is defined by a pair of oppositely facing substantially flat surfaces (53, 55) and the spaced jaw members (42, 44) define flat edge surfaces (43, 45) respectively which face one another for engaging a substantial portion of the flat surfaces of the blade (52) received therebetween.

11. An electrical contact for electrically interconnecting with a conductive blade, the contact characterized by at least two closely-spaced plate-portions (40*a*, 40*b*) which are interconnected by a bight (38) so as to be non-coplanar, each of the plate-portions having a longitudinal edge (41*b*) and like disposed forward and rearward lateral edges (41*a*, 41*d*) and each being connected by the bight (38) extending along the longitudinal edge (41*b*), each plate-portion including a pair of jaw members (42, 44), each pair of jaw members extending longitudinally inward from its lateral edge (41*a*) and each plate-portion being interconnected so that the jaw members cooperate to form one common jaw for simultaneously receiving the blade, each pair of jaw members defining a longitudinally extending and laterally narrowing slot (46) which includes an opening (46*a*) on the lateral edge (41*a*) and an inward narrowed portion (46*b*, ) the opening (46*a*) being sized to receive the blade and the narrowed portion (46*b*) being sized to form a constriction for holding the blade.

12. An electrical contact as required by claim 11 wherein each of the plate-portions (40*a*, 40*b*) are substantially parallel to one another.

13. An electrical connection, comprising: a pair of housings (10, 20) and first and second electrical contacts (50,30) assembled in mated relation, each housing having a passage receiving one of the contacts, each contact being longitudinally extending and having a forward end portion (52, 34) for mating and each of the contacts being disposed in the passages such that their forward end portions (52,34) are in mated relation the connection characterized by:

a generally V-shaped blade (52) simultaneously engaging each of a plurality of plate portions (40*a*, 40*b*, 40*c*, 40*d*) so interconnected that adjacent plate portions are facing one another, said V-shaped blade (52) comprising the forward mating end of said first electrical contact (50) and being defined by a pair of lateral surfaces (53,55) which intersect to form a leading edge (51), and said plate portions (40*a*–40*d*) comprising the forward mating end of said second electrical contact (30) with each plate portion having a narrow slot (46) extending longitudinally inwardly from a like disposed forward lateral edge (41*a*) thereof to define a pair of spaced opposing jaw members (42, 44) which engage the blade, each said slot (46) having a gradually diverging portion forming an opening (46*a*) for receiving leading edges (51) and a substantially parallel portion engaging the blade (52).

14. An electrical connection as required by claim 13 wherein each of the slots (46) are aligned with and is registered with one another.

15. An electrical connection as required by claim 14 wherein the flat surfaces (53, 55) of the blade (52) and the blade engaging edge surfaces (43, 45) of the jaw members (42, 44) are disposed in substantially the same plane.

16. An electrical interconnection between an electrical contact and a conductive blade, the interconnection characterized by:

said blade (52) being unitary and including acutely angled, laterally extending, contact surfaces (53, 55); and said electrical contact being stamped and formed from generally flat sheet metal and including a terminal element (34) comprising several pairs of longitudinally extending jaw members (42, 44), each respective pair of jaw members defining a longitudinal slot (46) and each being interconnected with the blade, each of said slots (46) being disposed in a different plane and said slots collectively defining the axis of a single uninterrupted passage that extends through all of said several pairs of jaw members such that said several pairs of jaw members cooperate to form one common jaw engaging the contact surfaces of the blade.

* * * * *